US007033743B2

(12) United States Patent
Geuens et al.

(10) Patent No.: US 7,033,743 B2
(45) Date of Patent: Apr. 25, 2006

(54) BARRIER LAYERS FOR USE IN SUBSTANTIALLY LIGHT-INSENSITIVE THERMOGRAPHIC RECORDING MATERIALS

(75) Inventors: Ingrid Geuens, Emblem (BE); Frank Loewet, Diepenbeek (BE); Peter Michiels, Schilde (BE)

(73) Assignee: Agfa Gevaert, Mortsel (BE)

( * ) Notice: Subject to any disclaimer, the term of this patent is extended or adjusted under 35 U.S.C. 154(b) by 107 days.

(21) Appl. No.: 10/737,552

(22) Filed: Dec. 16, 2003

(65) Prior Publication Data

US 2004/0126719 A1 Jul. 1, 2004

Related U.S. Application Data

(60) Provisional application No. 60/440,464, filed on Jan. 16, 2003.

(30) Foreign Application Priority Data

Dec. 19, 2002 (EP) ..... 02102831

(51) Int. Cl.
*G03C 1/494* (2006.01)
*G03C 1/76* (2006.01)

(52) U.S. Cl. ..... 430/536; 430/616; 430/620; 430/961; 430/964; 430/965; 503/210

(58) Field of Classification Search ..... 430/536, 430/616, 965, 620, 964, 961; 503/210
See application file for complete search history.

(56) References Cited

U.S. PATENT DOCUMENTS

| | | | | |
|---|---|---|---|---|
| 3,271,345 A | | 9/1966 | Nadeau et al. | |
| 3,437,484 A | | 4/1969 | Nadeau | |
| 3,832,186 A | | 8/1974 | Masuda et al. | |
| 3,933,508 A | | 1/1976 | Ohkubo et al. | |
| 4,197,131 A | | 4/1980 | Lea et al. | |
| 4,450,229 A | | 5/1984 | Reece | |
| 4,460,681 A | | 7/1984 | Frenchik | |
| 4,558,003 A | | 12/1985 | Sagawa | |
| 4,942,115 A | | 7/1990 | Przezdziecki | |
| 5,264,334 A | | 11/1993 | Przezdziecki et al. | |
| 5,422,234 A | * | 6/1995 | Bauer et al. | 430/527 |
| 5,582,953 A | * | 12/1996 | Uyttendaele et al. | 430/203 |
| 5,587,350 A | * | 12/1996 | Horsten et al. | 503/201 |
| 6,350,561 B1 | * | 2/2002 | Miller et al. | 430/353 |
| 6,352,819 B1 | | 3/2002 | Kenney et al. | |
| 6,420,102 B1 | * | 7/2002 | Bauer et al. | 430/350 |

FOREIGN PATENT DOCUMENTS

| | | |
|---|---|---|
| DE | 24 39 460 A | 2/1976 |
| EP | 0 536 955 A2 | 4/1993 |
| GB | 1 422 057 | 1/1976 |

OTHER PUBLICATIONS

Search Report for EP 02 10 2831 (Jul. 9, 2003).

* cited by examiner

*Primary Examiner*—Richard L. Schilling
(74) *Attorney, Agent, or Firm*—Leydig, Voit & Mayer, Ltd.

(57) ABSTRACT

A substantially light-insensitive black and white monosheet thermographic recording material has a support and on one side of the support comprises a thermosensitive element, a barrier layer and an outermost protective layer, the thermosensitive element being exclusive of a high contrast agent and containing at least one substantially light-insensitive silver salt of a carboxylic acid, at least one reducing agent therefor in thermal working relationship therewith, at least one toning agent and at least one binder, wherein the at least one reducing agent is an ortho-dihydroxy-benzene derivative and the barrier layer comprises a copolymer comprising vinyl chloride units and vinyl acetate and/or vinyl alcohol units, a copolymer comprising styrene units and acrylonitrile units, a copolymer comprising cationic units and/or a copolymer comprising styrene units and maleic acid units.

26 Claims, No Drawings

BARRIER LAYERS FOR USE IN SUBSTANTIALLY LIGHT-INSENSITIVE THERMOGRAPHIC RECORDING MATERIALS

CROSS-REFERENCE TO RELATED PATENT APPLICATIONS

This application claims the benefit of U.S. Provisional Application No. 60/440,464 filed Jan. 16, 2003, which is incorporated by reference. In addition, this application claims the benefit of European Application No. 02102831.1 filed Dec. 19, 2002, which is also incorporated by reference.

FIELD OF THE INVENTION

The present invention concerns barrier layers for use in substantially light-insensitive thermographic recording materials.

BACKGROUND OF THE INVENTION

Thermography is an image-forming process including a heating step and hence includes photothermography in which the image-forming process includes image-wise exposure and direct thermal processes in which the image-forming process includes an image-wise heating step. In direct thermal printing a visible image pattern is produced by image-wise heating of a recording material.

U.S. Pat. No. 3,832,186 discloses in EXAMPLE 9 a heat developing-out photosensitive material obtained by coating a polyethylene terephthalate film support with a composition comprising polyvinyl butyral, silver benzotriazole, mercuric bromide, a benzoxazolidene thiohydantoin sensitising dye, ascorbic acid monomyristate as reducing agent and 3-mercapto-5-phenyl-4-phenyl-1,2,4-triazole and overcoating this composition with a vinyl chloride-vinyl acetate copolymer (weight ratio 85:15).

U.S. Pat. No. 3,933,508 discloses a heat developable light-sensitive material comprising, on a support, (1) an organic silver salt, (2) a light-sensitive silver halide or silver-halide prepared by reacting the organic silver salt with a halide, (3) a reducing agent, (4) a binder, and (5) an overcoat layer overlying components (1)–(4); said components (1)–(4) occurring in a single coated layer consisting essentially of a polymer having a refractive index greater than about 1.45 at 20° C., having heat resistance to temperatures greater than about 46° C., being colorless and soluble in organic solvents, and providing increased transparency for said overcoat layer. Examples of polymers used for the overcoat layer according to U.S. Pat. No. 3,933,508, which are preferably heat-resistant, colorless and soluble in solvents, are polyvinyl chloride, polyvinyl acetate, copolymers of vinyl chloride and vinyl acetate containing more than 50 mol % vinyl chloride but insufficient vinyl chloride to lower the heat resistance, polyvinyl butyral, polystyrene, polymethyl methacrylate, benzyl cellulose, ethyl cellulose, cellulose acetate butyrate, cellulose acetate, polyvinylidene chloride, polyvinyl pyrrolidone, cellulose propionate, polyvinyl formal, cellulose acetate phthalate, polycarbonates and cellulose acetate propionate. Moreover, gelatin, gelatin derivatives such as phthalated gelatin, acrylamide polymers, polyisobutylene, butadiene-styrene copolymers (no limitation on monomer proportions) and polyvinyl alcohol are preferred. EXAMPLES 5, 10, 12 and 18 exemplify an overcoat comprising a vinyl chloride-vinyl acetate copolymer (95 wt % vinyl chloride, 5wt % vinyl acetate).

GB-A 1,422,057 discloses a heat-developable photosensitive material comprising, coated on a support, a layer of (1) an organic silver salt, (2) a light-sensitive silver halide as grains of which at least 30 mole % is silver iodide, (3) a reducing agent and (4) a spectrally sensitising dye adsorbed on the surface of the silver halide grains, which sensitizing dye has an oxidation potential not exceeding 1.00 volt and difference in values between its oxidation potential and its reduction potential of at least 2.00 volts. EXAMPLE 4 discloses a silver benzotriazolate-containing heat-developable photosensitive layer with a top-coat of a vinyl chloride-vinyl acetate copolymer (85:15 by weight).

DE-A 24 39 460 discloses a thermally developable photosensitive material, comprising coated on a support, (a) an organic silver salt, (b) a catalytic quantity of a silver halide or photosensitive silver-halide prepared by reacting the organic silver salt with a halide, (c) a reducing agent and (d) a binder, and an overcoat, which comprises a polymer layer with kaolin dispersed therein. DE-A 24 39 460 discloses the following overcoat polymers: (a) copolyesters; (b) nylon compounds; (c) vinylidene dichloride copolymers; (d) ethylene-vinyl acetate-copolymers; (e) cellulose ethers; (f) polyethylene; (g) synthetic rubbers; (h) cellulose esters; (i) polyvinylesters; (j) polyacrylates and α-alkyl-polyacrylate esters; (k) high molecular weight polyethylene oxides of polyglycols with an average molecular weight of about 4000 to 1,000,000; (l) polyvinyl chloride and copolymers; (m) polyvinyl acetals; (n) polyformaldehydes; (o) polyurethanes; (p) polycarbonates; (q) polystyrenes; (r) gelatins and their derivatives; (s) polyvinyl alcohol; (t) naturally occurring colloids. EXAMPLE 4 discloses an overcoat layer comprising a vinyl chloride-vinyl acetate copolymer (95:5 by weight).

U.S. Pat. No. 4,197,131 discloses a light-sensitive composition comprising an intimate mixture of a substantially light-sensitive silver compound which upon reduction gives a visible change and sufficient of a silver halide to catalyse said reduction to give a visible change in those areas where the silver halide has been exposed to light and when the mixture is heated in the presence of a reducing agent, and as a yellow acutance dye a 1-alkyl-4-nitromethylene-quinolane, the alkyl substituent containing 1 to 4 carbon-atoms. The EXAMPLES disclose overcoating of the light-sensitive dispersion with a layer comprising a vinyl chloride-vinyl acetate copolymer available from Union Carbide under the name VYNS.

The EXAMPLES of U.S. Pat. No. 4,450,229 disclose the overcoating of a photothermographic element comprising a binder, light sensitive silver halide in catalytic proximity to a light insensitive silver source material in said element which contains a reducible source of silver ions, a reducing agent for silver ion and an effective latent image stabilizing of a particular class of compounds, with a layer comprising a vinyl acetate-vinyl chloride copolymer (80 wt % vinyl acetate, 20 wt % vinyl chloride).

U.S. Pat. No. 4,558,003 discloses an unexposed photothermographic article comprising a support, a silver containing layer comprising a binder, a silver compound having reducible silver ions, silver halide in catalytic proximity to said silver compound, and a reducing agent for silver ion, said binder comprising at least 25 percent by weight of a poly(vinyl acetal), said article being characterized by the presence of an amount of borate ion, a boric acid salt, or a boric acid, alone, or in combination with an isocyanate, sufficient to harden said binder. EXAMPLE 1 exemplifies a top coat of a poly(vinyl acetate)/poly(vinyl chloride)copolymer (80/20).

U.S. Pat. No. 4,460,681 discloses a color photothermographic imageable article comprising a substrate, a photothermographic emulsion layer, and organic solvent soluble barrier layer, a second photothermographic emulsion layer on a polymeric cover layer, wherein each of the photothermographic layers comprise a reducible silver source, photosensitive silver halide, a reducing agent for silver ion and solvent soluble binder, and further wherein each photothermographic layer is sensitized to a portion of the spectrum at least 60 nm different from the other photothermographic layer and each photothermographic layer contains a leuco dye which when oxidized forms a feasible dye having a maximum absorbance at least 60 nm different from that of the dye formed in the at least one other photosensitive layer, and the barrier layer is between said photothermographic layers and is impermeable to the solvent contained in the second photothermographic layer. Second layer "barrier" polymers may, according to U.S. Pat. No. 4,460,681, be maleic anhydride/vinyl methyl ether copolymers, polyvinylidene chloride (SARAN™), or polyvinylpyrrolidone, with maleic acid copolymers such as alkyl monoesters of poly(methyl vinyl ether/maleic acid) being preferred. The "barrier" polymer, which is the fourth layer and preferably contains the color reactants, is normally a methyl methacrylate polymer (preferably a hard polymer with a Tukon hardness of 20 or more), copolymer, or blend with other polymers or copolymers (e.g. copolymer with n-butyl acrylate, butyl methacrylate, and other acrylates such as acrylic acid, methacrylic acid, acrylic anhydride, and the like), polystyrene, or a combination of a polyvinyl chloride tripolymer with a butadiene-styrene copolymer. The preferred polymer is a hard methyl methacrylate homopolymer blended with soft methyl methacrylate copolymers. In EXAMPLE 5, a yellow/magenta barrier coating is disclosed of a butadiene/styrene copolymer and a polyvinyl chloride/acetate/alcohol) polymer (VAGH).

EP-A 0 536 955 discloses a heat developable photothermographic article comprising: (a) an image-receiving element comprising a polymeric image-receiving layer; and (b) strippably adhered to said image-receiving element, an imageable photothermographic element comprising a plurality of emulsion layers, each of which emulsion layers comprises a binder, a silver source material, and a leuco dye, and interposed between each pair of said emulsion layers a dye-permeable interlayer. EP-A 0 536 955 further discloses that the first interlayer must be impermeable to solvents to be used for applying the subsequent coating; however, the polymer for forming the first interlayer can be applied from any organic solvent. The polymer of the first interlayer is preferably a thermoplastic polymer. Homopolymers of vinyl chloride or copolymers of vinyl chloride, preferably having a glass transition temperature greater than 80° C., for example, a copolymer of vinyl chloride(96%) and vinyl acetate (4%), a blend of poly(vinyl chloride)(90%) and poly(vinyl acetate)(10%), can be used to form the first interlayer. EXAMPLE 1 exemplifies an interlayer comprising a terpolymer of vinyl chloride(83%), vinyl acetate(16%) and maleic acid(1%).

U.S. Pat. No. 4,942,115 discloses a thermally processable imaging element comprising a support bearing a thermally processable hydrophobic imaging layer and, on the side of the imaging layer away from the support, an overcoat layer comprising poly(silicic acid) and a hydrophilic monomer or polymer, wherein the element comprises a polymeric adhesion promoting layer between the overcoat and the imaging layer. U.S. Pat. No. 4,942,115 discloses that polymers that are useful in the polymeric adhesion promoting layer are: (1) terpolymers of 2-propenenitrile, 1,1-dichloroethene, and propenoic acid, such as disclosed in U.S. Pat. No. 3,271,345; and (2) terpolymers of 2-propenoic acid, methyl ester, 1,1-dichloroethene and itaconic acid as disclosed in, for example, U.S. Pat. No. 3,437,484, with a polymeric adhesion layer comprising poly(2-propenenitrile co-1,1-dichloroethene-co-2-propenoic acid) or poly(2-propenoic acid, methyl-ester-co-1,1dichloroethene-co-itaconic acid) being preferred and poly(2-propenenitrile co-1,1-dichloroethene-co-2-propenoic acid) being exemplified.

U.S. Pat. No. 6,352,819 discloses a high contrast black-and-white photothermographic material comprising a support having thereon: (a) a thermally developable, high contrast imaging layer(s) comprising a binder and in reactive association, photosensitive silver halide, a non-photosensitive source of reducible silver ions, a reducing composition for said non-photosensitive source reducible silver ions, and a high contrast agent, and (b) a barrier layer that is on the same side but farther from said support than said high contrast imaging layer(s), said barrier layer comprising a film-forming polymer and being impermeable to or reactive with any components that are diffusible from said image-forming layer(s) at a temperature greater than 80° C. U.S. Pat. No. 6,352,819 further discloses but does not claim a high contrast black-and-white thermographic material comprising a support having thereon: (a) a thermally developable and non-photosensitive, high contrast imaging layer(s) comprising a binder and in reactive association, a non-photosensitive source of reducible silver ions, a reducing composition for said non-photosensitive source reducible silver ions, and a high contrast agent, and (b) a barrier layer that is farther from the support than the high contrast imaging layer(s), the barrier layer comprising a film-forming polymer and being impermeable to or reactive with any components that are diffusible from said image-forming layer(s) at a temperature greater than 80° C. The term thermographic material is a generic term which includes photothermographic materials and the recitation of the high contrast thermographic material does not exclude the presence of photosensitive species such as photosensitive silver halide. There is therefore no specific disclosure in U.S. Pat. No. 6,352,819 concerning substantially light-insensitive thermographic materials and moreover U.S. Pat. No. 6,352,819 contains no examples devoted to substantially light-insensitive thermographic materials. Some particularly useful barrier materials, according to U.S. Pat. No. 6,352,819, include polyvinyl alcohol, a styrene polymer (including polymers of styrene derivatives), a vinyl halide polymer, a vinyl acetate polymer [such as polyvinyl acetate, poly(ethylene-co-vinyl acetate) or a copolymer of a vinyl halide and vinyl acetate], a polyvinyl pyrrolidone, a water-soluble or water-dispersible polyester, and gelatin (including deionised and acid processed gelatin) or a gelatin derivative (such as phthalated gelatin and carbamoylated gelatin, with the styrene polymers, vinyl acetate polymers and polyvinyl alcohol being preferred. EXAMPLE 12 discloses a barrier layer comprising poly(vinyl chloride-co-vinyl acetate), EXAMPLE 32 discloses a barrier layer comprising poly (styrene-co-acrylonitrile) (75:25 weight), EXAMPLE 33 discloses a barrier layer comprising U CAR VYNS poly (vinyl chloride-co-vinyl acetate) from Union Carbide and EXAMPLE 34 discloses a barrier layer comprising U CAR VAGH poly(vinyl chloride-co-acetate-co-vinyl alcohol) from Union Carbide.

It has been found that, in order to achieve a neutral image tone in substantially light-insensitive black and white monosheet thermographic materials, reducing agents and toning agents are required which diffuse to the surface of the material despite the presence of an outermost protective layer both during storage before printing and after printing and results, in extreme cases, in the user visually observing deposits of reducing agents, toning agents and reaction products of the imaging-forming process on the surface of the materials. Substantially light-insensitive black and white monosheet thermographic materials are therefore required which exhibit an acceptably neutral image tone, but do not exhibit the formation of such deposits of reducing agents, toning agents and reaction products of the imaging-forming process.

ASPECTS OF THE INVENTION

It is therefore an aspect of the present invention to provide a substantially light-insensitive black and white monosheet thermographic material, which exhibits acceptably neutral image tone, but do not exhibit the formation of surface deposits comprising, for example, reducing agent, toning agent and carboxylic acid.

Further aspects and advantages of the invention will become apparent from the description hereinafter.

SUMMARY OF THE INVENTION

U.S. Pat. No. 6,352,819 teaches the barrier layer comprises a film-forming polymer(s) that reacts with or acts as a physical barrier to diffusible by-products resulting from the presence of high contrast agents such as acrylonitrile co-developers, hydrazide co-developers and isoxazole codevelopers. It has been surprisingly found that prints of substantially light-insensitive black and white monosheet thermographic materials with thermosensitive elements not containing a high contrast agent and containing at least one substantially light-insensitive silver salt of a carboxylic acid, ortho-dihydroxy-benzene derivatives as reducing agents in combination with a barrier layer comprising a copolymer comprising vinyl chloride units and vinyl acetate units and/or vinyl alcohol units and/or a copolymer comprising styrene units and acrylonitrile units inserted between the outermost protective layer and the thermosensitive element exhibit acceptably neutral image tones, as characterized by CIELAB a* and b* values, and that surface deposits are neither formed prior to printing nor after printing. The L*, a* and b* CIELAB-values were determined by spectrophotometric measurements according to ASTM Norm E179-90 in a R(45/0) geometry with evaluation according to ASTM Norm E308-90.

Aspects of the present invention are realized with a substantially light-insensitive black and white monosheet thermographic recording material has a support and on one side of the support comprises a thermosensitive element, a barrier layer and an outermost protective layer, the thermosensitive element being exclusive of a high contrast agent and containing comprising a substantially light-insensitive silver salt of a carboxylic acid, at least one reducing agent therefor in thermal working relationship therewith, at least one toning agent and a binder, wherein the at least one reducing agent is an ortho-dihydroxy-benzene derivative and the barrier layer comprises a copolymer comprising vinyl chloride units and vinyl acetate units and/or vinyl alcohol, a copolymer comprising styrene units and acrylonitrile units, a copolymer comprising cationic units and/or a copolymer comprising styrene units and maleic acid units.

Preferred embodiments of the present invention are disclosed in the detailed description of the invention.

DETAILED DESCRIPTION OF THE INVENTION

Definitions

The term alkyl means all variants possible for each number of carbon atoms in the alkyl group i.e. for three carbon atoms: n-propyl and isopropyl; for four carbon atoms: n-butyl, isobutyl and tertiary-butyl; for five carbon atoms: n-pentyl, 1,1-dimethyl-propyl, 2,2-dimethylpropyl and 2-methyl-butyl etc.

The term acyl group as used in disclosing the present invention means —(C═O)-aryl and —(C═O)-alkyl groups.

The L*, a* and b* CIELAB-values are defined in ASTM Norm E179-90 in a R(45/0) geometry with evaluation according to ASTM Norm E308-90.

Substantially light-insensitive means not intentionally light sensitive.

The term "high contrast agent", which are sometimes identified as "co-developers" or "auxiliary developers", have as their main function an increase in the contrast of the material by reducing most or all of the reducible silver ions in the substantially light-insensitive silver salt of a carboxylic acid in the radiation-exposed areas e.g. acrylonitrile co-developers, hydrazide co-developers and isoxazole codevelopers as disclosed in U.S. Pat. No. 6,352,819 herein incorporated by reference.

Heating in association with the expression a substantially water-free condition as used herein, means heating at a temperature of 80 to 250° C. The term "substantially water-free condition" as used herein means that the reaction system is approximately in equilibrium with water in the air, and water for inducing or promoting the reaction is not particularly or positively supplied from the exterior to the element. Such a condition is described in T. H. James, "The Theory of the Photographic Process", Fourth Edition, Macmillan 1977, page 374.

Thermosensitive Element

The term thermosensitive element as used herein is that element which contains all the ingredients, which contribute to image formation. According to the substantially light-insensitive black and white monosheet thermographic recording material, according to the present invention, the thermosensitive element contains at least a substantially light-insensitive silver salt of a carboxylic acid, an ortho-dihydroxy-benzene derivative reducing agent therefor in thermal working relationship therewith, a toning agent and a binder. The thermosensitive element may comprise a layer system in which the above-mentioned ingredients may be dispersed in different layers, with the proviso that the substantially light-insensitive silver salt of a carboxylic acid is in reactive association with the ortho-dihydroxy-benzene derivative reducing agent i.e. during the thermal development process the reducing agent must be present in such a way that it is able to diffuse to the particles of the substantially light-insensitive silver salt of a carboxylic acid, so that reduction to silver can occur. Such materials include the possibility of the substantially light-insensitive silver salt of a carboxylic acid and/or the ortho-dihydroxy-benzene derivative reducing agent therefor being encapsulated in heat-responsive microcapsules, such as disclosed in EP-A 0 736 799 herein incorporated by reference.

Substantially Light-insensitive Silver Salt of a Carboxylic Acid

According to a first embodiment of the substantially light-insensitive black and white monosheet thermographic recording material, according to the present invention, the substantially light-insensitive silver salt of a carboxylic acid is not a double organic salt containing a silver cation associated with a second cation e.g. magnesium or iron ions.

According to a second embodiment of the substantially light-insensitive black and white monosheet thermographic recording material, according to the present invention, said substantially light-insensitive silver salt of an carboxylic acid is a substantially light-insensitive silver salt of an aliphatic carboxylic acids known as a fatty acid, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Other silver salts of an organic carboxylic acid as described in GB-P 1,439,478, e.g. silver benzoate, may likewise be used to produce a thermally developable silver image. Combinations of different silver salts of an organic carboxylic acids may also be used in the present invention, as disclosed in EP-A 964 300 herein incorporated by reference.

Ortho-dihydroxy-benzene Derivative

According to a third embodiment of the substantially light-insensitive black and white monosheet thermographic recording material, according to the present invention, the ortho-dihydroxy-benzene derivative is selected from the group consisting of catechol, 3-(3,4-dihydroxyphenyl) propionic acid, 3,4-dihydroxybenzoic acid, 3,4-dihydroxybenzoic acid esters, gallic acid, gallic acid esters, e.g. methyl gallate, ethyl gallate and propyl gallate, 3,4-dihydroxybenzaldehyde, 3,4-dihydroxy-acetophenone, 3,4-butyrophenone, 3,4-dihydroxy-benzophenone, 3,4-dihydroxybenzophenone derivatives, 3,4-dihydroxy-benzonitrile, and tannic acid, as disclosed in EP-A 0 692 733, EP-A 0 903 625, EP-A 1 245 403 and EP-A 1 245 404 herein incorporated by reference.

Combinations of reducing agents may also be used that on heating become reactive partners in the reduction of the one or more substantially light-insensitive organic silver salt. For example, combinations of sterically hindered phenols with sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents as disclosed in U.S. Pat. No. 5,545,505, U.S. Pat. No. 5,545,507 and U.S. Pat. No. 5,558,983; acrylonitrile compounds as disclosed in U.S. Pat. No. 5,545,515 and U.S. Pat. No. 5,635,339; and 2-substituted malonodialdehyde compounds as disclosed in U.S. Pat. No. 5,654,130.

Toning Agent

According to a fourth embodiment of the substantially light-insensitive black and white monosheet thermographic recording material, according to the present invention, the at least one toning agent is selected from the group consisting of phthalazinone, phthalazinone derivatives, benzoxazine dione, benzoxazine dione derivatives, naphthoxazine dione and naphthoxazine derivatives, pyridazone, pyridazone derivatives, compounds represented by formula (I):

(I)

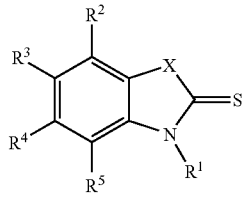

wherein $R^1$ is an alkyl group optionally substituted with a hydroxy, carboxy, carboxy ester, acyl or carbonato group; X is S, O or N—$R^6$; $R^6$ is an optionally substituted alkyl group; $R^2$, $R^3$, $R^4$ and $R^5$ independently represent a hydrogen atom, a halogen atom or an alkyl, an alkoxy, a thio-alkoxy, a nitro, a cyano, a carboxy, a carboxy ester, an acyl, an aldehyde, an acylamido, a sulphonamido, an acylamino, a carbonato, a hydroxy or an aryl group or at least one of $R^2$ and $R^3$, $R^3$ and $R^4$ and $R^4$ and $R^5$ independently represent the atoms necessary to form a carbocyclic or heterocyclic group or at least one of $R^1$ and $R^5$ and $R^2$ and $R^6$ independently represent the atoms necessary to form a heterocyclic ring; compounds represented by formula (II):

(II)

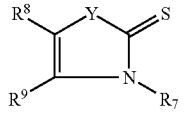

wherein $R^7$ is an optionally substituted alkyl group; Y is S, O or N—$R^{10}$; $R^{10}$ is an optionally substituted alkyl group; $R^8$ and $R^9$ independently represent a hydrogen atom, a halogen atom or an alkyl, an alkoxy, a thio-alkoxy, a nitro, a cyano, a carboxy, a carboxy ester, an acyl, an aldehyde, an acylamido, a sulphonamido, an acylamino, a carbonato, a hydroxy or an aryl group or $R^8$ and $R^9$ represent the atoms necessary to form a heterocyclic or a non-aromatic carbocyclic ring or at least one of $R^8$ and $R^{10}$ and $R^9$ and $R^7$ independently represent the atoms necessary to form a heterocyclic ring; and both $R^8$ and $R^9$ cannot both be an alkyl group; and compounds represented by formula (III):

(III)

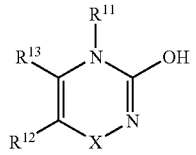

wherein $R^{11}$ is a hydrogen atom or a C1 to C3 alkyl, a C1 to C3 alkenyl, a C1 to C3 alkynyl, a cycloalkyl, an alkaryl, an aryl, a heterocyclic or a heteroaryl group all of which may be optionally substituted; with the proviso that $R^{11}$ may not be a hydrogen atom if both $R^{12}$ and $R^{13}$ are both hydrogen atoms; $R^{12}$ and $R^{13}$ are independently a hydrogen atom or an amide, ester, carboxy, carbonato, alkyl, alkenyl, alkynyl, cycloalkyl, alkaryl, aryl, heterocyclic or heteroaryl group all of which may be optionally substituted; $R^{12}$ and $R^{13}$ may together represent the atoms necessary to complete an alicyclic, a heterocyclic or a heteroaromatic ring which all may be optionally substituted; and X is a carbonyl group, or is —N—$R^{14}$, where $R^{14}$ is an alkyl group.

Suitable optional substituents for the alkyl groups of $R^1$, $R^6$, $R^7$ and $R^{10}$ are independently include carboxy and carboxy ester groups. Suitable substituted alkyl groups include: —$CH_2COOH$, —$C_2H_4COOH$ and —$C_2H_4COOC_2H_5$.

Suitable benzoxazine dione toning agents for use in the thermographic material, according to the present invention, are disclosed in GB 1,439,478, U.S. Pat. No. 3,951,660 and U.S. Pat. No. 5,599,647, herein incorporated by reference.

Binder of the Thermosensitive Element

The film-forming binder of the thermosensitive element may be all kinds of natural, modified natural or synthetic resins or mixtures of such resins, in which the at least one organic silver salt can be dispersed homogeneously either in aqueous or solvent media: e.g. cellulose derivatives, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylates, polymethacrylates, polystyrene and polyethylene or mixtures thereof.

Suitable water-soluble film-forming binders for use in thermographic recording materials according to the present invention are: polyvinyl alcohol, polyacrylamide, polymethacrylamide, polyacrylic acid, polymethacrylic acid, polyvinylpyrrolidone, polyethyleneglycol, proteinaceous binders, polysaccharides and water-soluble cellulose derivatives. A preferred water-soluble binder for use in the thermographic recording materials of the present invention is gelatine.

The binder to organic silver salt weight ratio is preferably in the range of 0.2 to 7, and the thickness of the thermosensitive element is preferably in the range of 5 to 50 μm. Binders are preferred which do not contain additives, such as certain antioxidants (e.g. 2,6-di-tert-butyl-4-methylphenol), or impurities which adversely affect the thermographic properties of the thermographic recording materials in which they are used.

Barrier Layer

Aspects of the present invention are realized with substantially light-insensitive black and white monosheet thermographic recording material has a support and on one side of the support comprises a thermosensitive element, a barrier layer and an outermost protective layer, the thermosensitive element being exclusive of a high contrast agent and containing at least one substantially light-insensitive silver salt of a carboxylic acid, at least one reducing agent therefor in thermal working relationship therewith, at least one toning agent and a binder, wherein the at least one reducing agent is an ortho-dihydroxy-benzene derivative and the barrier layer comprises a copolymer comprising vinyl chloride units and vinyl acetate and/or vinyl alcohol units, a copolymer comprising styrene units and acrylonitrile units, a copolymer comprising cationic units and/or a copolymer comprising styrene units and maleic acid units.

According to a fifth embodiment of the substantially light-insensitive black and white monosheet thermographic recording material, according to the present invention, the barrier layer is interposed between the thermosensitive element and the outermost protective layer.

The mechanism of the restraining influence of the barriers layers, according to the present invention, upon the diffusion of ingredients and reaction products of the imaging forming process to the surface of the protective layer is unknown, but it is believed that these layers may perform a dual role in providing an impervious barrier for certain of the ingredients and reacting with others of the diffusing species. The copolymers used in the barrier layer of the thermographic material, according to the present invention, all have a more polar species, e.g. vinyl chloride, acrylonitrile, maleic acid and cationic units, and less polar species, e.g. styrene and vinyl acetate. Such polar species could represent a barrier to the diffusion of non-polar species.

According to a sixth embodiment of the substantially light-insensitive black and white monosheet thermographic recording material, according to the present invention, the copolymer comprising vinyl chloride units and vinyl acetate units contains up to 95% by weight of vinyl chloride. The weight ratio of vinyl chloride to vinyl acetate has not been found to be critical. Further comonomers may be present, but have not been found to be critical to the performance of the copolymer as a barrier to diffusion of ingredients or reaction products from the image-forming process.

According to a seventh embodiment of the substantially light-insensitive black and white monosheet thermographic recording material, according to the present invention, the copolymer comprising styrene units and acrylonitrile units contains between 20 and 60% by weight of acrylonitrile.

According to an eighth embodiment of the substantially light-insensitive black and white monosheet thermographic recording material, according to the present invention, the copolymer containing cationic units contains quaternary ammonium, quaternary phosphonium or ternary sulphonium units.

According to a ninth embodiment of the substantially light-insensitive black and white monosheet thermographic recording material, according to the present invention, the copolymer containing cationic units contains methacrylamidopropyl-trimethylammonium chloride or dimethyl-diallylammonium chloride units.

It has been found that the barrier layers exhibit an optimal restraining influence upon the diffusion of ingredients and reaction products of the imaging forming process when coated from coating-solutions containing 5 to 20% by weight of the copolymer and/or with wet layer thicknesses of 5 to 20 μm.

Suitable copolymers for use in the substantially light-insensitive black and white monosheet thermographic recording material, according to the present invention, include:

| Co-polymer nr. | Copolymer composition |
|---|---|
| 1 | VINNOL ™ E15 45, a vinyl chloride-vinyl acetate-copolymer (85:15 by weight) from Wacker Chemie |
| 2 | VINNOL ™ E15 45M, a vinyl chloride-vinyl acetate-maleic acid anhydride-copolymer (80.9:18.5:0.6 by weight) from Wacker Chemie |

-continued

| Co-polymer nr. | Copolymer composition |
|---|---|
| 3 | VINNOL ™ E15 45A, a vinyl chloride-vinyl alcohol-copolymer (83.5:16.5 by weight) from Wacker Chemie |
| 4 | VINNOL ™ H40 60, a vinyl chloride-vinyl acetate-copolymer (60:40 by weight) from Wacker Chemie |
| 5 | VINYLITE ™ VAGD, a vinyl chloride-vinyl acetate-vinyl alcohol-copolymer (91:3:6 by weight) from Rohm and Haas Company |
| 6 | LUSTRAN ™ SAN28, a styrene-acrylonitrile-copolymer (75:25 by weight) from BAYER |
| 7 | LURAN ™ 378P, a styrene-acrylonitrile-copolymer (67.5:32.5 by weight) from BASF |
| 8 | LURAN ™ 388S natur, a styrene-acrylonitrile-copolymer (67.8:32.2 by weight) from BASF |
| 9 | LURAN ™ 358N, a styrene-acrylonitrile-copolymer (64:36 by weight) from BASF |
| 10 | LUSTRAN ™ SAN CN25, a styrene-acrylonitrile-copolymer (54:46 by weight) from BAYER |
| 11 | POVAL CM318, methacrylamidopropyl trimethylammonium chloride-vinyl acetate-vinyl alcohol-copolymer, 88.5 mol % gehydrolyseerd with 2.5 mol % $N^+$, from Kuraray |
| 12 | POVAL C118, a methacrylamidopropyl trimethylammoniumchloride-vinyl acetate-vinylalcohol-copolymer, 99.4 mol % hydrolyzed with 0.5 mol % $N^+$ from Kuraray |
| 13 | POVAL C506, a 75.5% hydrolyzed methacrylamidopropyl trimethylammoniumchloride-vinyl alcohol-vinyl acetate-copolymer with 0.5 mol % $N^+$ from Kuraray |
| 14 | a styrene-maleic acid copolymer (50/50 mol %) as a 10% by weight aqueous solution with pH 7 |
| 15 | GOSHEFIMER K210, a 85.8–88% hydrolyzed vinyl acetate-vinyl alcohol with ca. 1 mol % dimethyl-diallylammonium chloride-copolymer from Nippon Goshei |

Protective Layer

In general the outermost protective layer protects the thermosensitive element from atmospheric humidity and from surface damage by scratching etc. and prevents direct contact of printheads or heat sources with the recording layers. Protective layers for thermosensitive elements which come into contact with and have to be transported past a heat source under pressure, have to exhibit resistance to local deformation and good slipping characteristics during transport past the heat source during heating. A slipping layer, being the outermost layer, may comprise a dissolved lubricating material and/or particulate material, e.g. talc particles, optionally protruding from the outermost layer. Examples of suitable lubricating materials are a surface-active agent, a liquid lubricant, a solid lubricant or mixtures thereof, with or without a polymeric binder.

According to a tenth embodiment of the substantially light-insensitive black and white monosheet thermographic recording material, according to the present invention, the outermost protective layer comprises the reaction product of at least one hydrolyzed polyalkoxysilane and a hydroxy-group containing polymer.

According to an eleventh embodiment of the substantially light-insensitive black and white monosheet thermographic recording material, according to the present invention, the outermost protective layer comprises the reaction product of a hydrolyzed tetra-alkoxysilane, e.g. tetramethoxysilane or tetra-ethoxysilane, and polyvinyl alcohol.

Stabilizers

According to a twelfth embodiment of the substantially light-insensitive black and white monosheet thermographic recording material, according to the present invention, the thermosensitive element further contains a stabilizer.

According to a thirteenth embodiment of the substantially light-insensitive black and white monosheet thermographic recording material, according to the present invention, the thermosensitive element further contains a stabilizer selected from the group consisting of benzotriazole; substituted benzotriazoles; aromatic polycarboxylic acid, such as ortho-phthalic acid, 3-nitro-phthalic acid, tetrachlorophthalic acid, mellitic acid, pyromellitic acid and trimellitic acid and anhydrides thereof; 1-phenyl-5-mercapto-tetrazole compounds in which the phenyl group is substituted with a substituent containing an optionally substituted aryl group, 1-(5-mercapto-1-tetrazolyl)-acetyl compounds represented by formula (IV):

(IV)

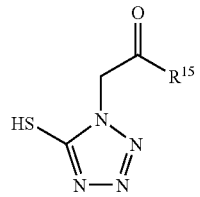

wherein $R^{15}$ is —$NR^{16}R^{17}$, —$OR^{18}$ or an optionally substituted aryl or heteroaryl group; $R^{16}$ is hydrogen or an optionally substituted alkyl, aryl or heteroaryl group; $R^{17}$ is an optionally substituted aryl or heteroaryl group; and $R^{18}$ is an optionally substituted aryl group; and compounds with two or more groups represented by formula (V):

(V)

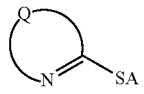

where Q comprises the necessary atoms to form a 5- or 6-membered unsaturated heterocyclic ring, A is hydrogen, a counterion to compensate the negative charge of the thiolate group or two or more A groups provide a linking group between the two or more groups represented by formula (V).

According to a fourteenth embodiment of the substantially light-insensitive black and white monosheet thermographic recording material, according to the present invention, the thermosensitive element further contains at least one optionally substituted aliphatic or carbocyclic polycarboxylic acid and/or anhydride thereof in a molar percentage of at least 15 with respect to all the organic silver salt(s) present and in thermal working relationship therewith. The polycarboxylic acid may be used in anhydride form or partially esterified on the condition that at least two free carboxylic acids remain or are available during the heat recording step.

Surfactants and Dispersants

Surfactants and dispersants aid the dispersion of ingredients, which are insoluble in the particular dispersion medium. The substantially light-insensitive thermographic material used in the present invention may contain one or more surfactants, which may be anionic, non-ionic or cationic surfactants and/or one or more dispersants. Suitable dispersants are natural polymeric substances, synthetic polymeric substances and finely divided powders, e.g. finely divided non-metallic inorganic powders such as silica. It has been found that the addition of a silicone oil to the coating solution of the Copolymer endowed the barrier coating solution with improved wetting properties.

According to a fifteenth embodiment of the substantially light-insensitive black and white monosheet thermographic recording material, according to the present invention, the barrier layer contains a silicone oil.

Support

According to a sixteenth embodiment of the substantially light-insensitive black and white monosheet thermographic recording material, according to the present invention, the support is transparent or translucent. It is preferably a thin flexible carrier made transparent resin film, e.g. made of a cellulose ester, e.g. cellulose triacetate, polypropylene, polycarbonate or polyester, e.g. polyethylene terephthalate. The support may be in sheet, ribbon or web form and subbed if needs be to improve the adherence to the thereon coated thermosensitive element. The support may be dyed or pigmented to provide a transparent coloured background for the image.

Coating Techniques

The coating of any layer of the substantially light-insensitive thermographic material used in the present invention may proceed by any coating technique e.g. such as described in Modern Coating and Drying Technology, edited by Edward D. Cohen and Edgar B. Gutoff, (1992) VCH Publishers Inc., 220 East 23rd Street, Suite 909 New York, N.Y. 10010, USA. Coating may proceed from aqueous or solvent media with overcoating of dried, partially dried or undried layers.

Thermographic Processing

Thermographic imaging is carried out by the image-wise application of heat either in analogue fashion by direct exposure through an image or by reflection from an image, or in digital fashion pixel by pixel either by using an infra-red heat source, for example with a Nd—YAG laser or other infra-red laser, with a substantially light-insensitive thermographic material preferably containing an infra-red absorbing compound, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy into heat via Joule effect. The operating temperature of common thermal printheads is in the range of 300 to 400° C. and the heating time per picture element (pixel) may be less than 1.0 ms, the pressure contact of the thermal printhead with the recording material being e.g. 200–1000 g/linear cm, i.e. with a contact zone (nip) of 200 to 300 μm a pressure of 5000 to 50,000 g/cm$^2$, to ensure a good transfer of heat.

In order to avoid direct contact of the thermal printing heads with the outermost layer on the same side of the support as the thermosensitive element when this outermost layer is not a protective layer, the image-wise heating of the recording material with the thermal printing heads may proceed through a contacting but removable resin sheet or web wherefrom during the heating no transfer of recording material can take place.

Activation of the heating elements can be power-modulated or pulse-length modulated at constant power. EP-A 654 355 discloses a method for making an image by image-wise heating by means of a thermal head having energizable heating elements, wherein the activation of the heating elements is executed duty cycled pulsewise. EP-A 622 217 discloses a method for making an image using a direct thermal imaging element producing improvements in continuous tone reproduction.

Image-wise heating of the recording material can also be carried out using an electrically resistive ribbon incorporated into the material. Image- or pattern-wise heating of the recording material may also proceed by means of pixel-wise modulated ultra-sound.

Industrial Application

Thermographic imaging can be used for the production of reflection type prints and transparencies, in particular for use in the medical diagnostic field in which black-imaged transparencies are widely used in inspection techniques operating with a light box.

The invention is illustrated hereinafter by way of comparative examples and invention examples. The percentages and ratios given in these examples are by weight unless otherwise indicated.

Subbing layer Nr. 01 on the emulsion side of the support has the composition:

| | |
|---|---|
| copolymer of 88% vinylidene chloride, 10% methyl acrylate and 2% itaconic acid | 79.1 mg/m$^2$ |
| Kieselsol ® 100° F., a colloidal silica from BAYER | 18.6 mg/m$^2$ |
| Mersolat ® H, a surfactant from BAYER | 0.4 mg/m$^2$ |
| Ultravon ® W, a surfactant from CIBA-GEIGY | 1.9 mg/m$^2$ |

Ingredients in the thermosensitive element in addition to the above-mentioned ingredients:
BL5HP = S-LEC BL5HP, a polyvinyl butyral from SEKISUI;
Oil = BAYSILON, a silicone oil from BAYER;
VL = DESMODUR VL, a 4,4'-diisocyanatodiphenylmethane from BAYER
Reducing agents:
R01 = 3,4-dihydroxybenzonitrile;
R02 = 3,4-dihydroxybenzophenone;
R03 = ethyl 3,4-dihydroxybenzoate
Stabilizers:
S01 = glutaric acid
S02 = tetrachlorophthalic acid anhydride
S03 = benzotriazole
S04 = adipic acid Compositions of thermosensitive elements used:

| | Thermosensitive element types | | | | |
|---|---|---|---|---|---|
| | 1 | 2 | 3 | 4 | 5 |
| AgBeh [g/m$^2$] | 3.94 | 4.150 | 3.960 | 4.15 | 4.42 |
| BL5HP [g/m$^2$] | 15.32 | 16.601 | 15.841 | 16.60 | 16.796 |
| R01 [g/m$^2$] | 0.595 | 0.439 | — | — | 0.618 |
| R02 [g/m$^2$] | 0.566 | 0.894 | — | — | — |
| R03 [g/m$^2$] | — | — | 0.940 | 0.845 | 0.515 |
| BOD01 [g/m$^2$] | — | — | 0.216 | — | — |
| BOD02 [g/m$^2$] | 0.111 | — | 0.111 | 0.116 | 0.226 |
| BOD03 [g/m$^2$] | 0.156 | 0.246 | — | — | — |
| BOD04 [g/m$^2$] | — | — | — | 0.269 | — |
| S01 [g/m$^2$] | 0.256 | 0.294 | 0.283 | 0.297 | 0.287 |

-continued

| | Thermosensitive element types | | | | |
|---|---|---|---|---|---|
| | 1 | 2 | 3 | 4 | 5 |
| S02 [g/m$^2$] | 0.126 | 0.130 | 0.125 | 0.132 | 0.139 |
| S03 [g/m$^2$] | 0.105 | 0.109 | 0.103 | 0.110 | 0.116 |
| VL [g/m$^2$] | 0.175 | 0.190 | — | — | — |
| Oil [g/m$^2$] | 0.035 | 0.037 | 0.035 | 0.037 | 0.039 |

Ingredients in the barrier layers:

| Polymer nr | Copolymer composition |
|---|---|
| 1 | reaction product of hydrolyzed tetramethoxy-silane and polyvinyl alcohol (ERCOL ™ 48 20) [0.166:2 by weight] |
| 2 | reaction product of hydrolyzed tetramethoxy-silane and polyvinyl alcohol (ERCOL ™ 48 20) [1.690:2 by weight] |
| 3 | reaction product of hydrolyzed tetramethoxy-silane and polyvinyl alcohol (ERCOL ™ 48 20) [3.379:2 by weight] |
| 4 | reaction product of hydrolyzed tetramethoxy-silane and polyvinyl alcohol (ERCOL ™ 48 20) [5.069:2 by weight] |
| 5 | cellulose acetate butyrate |
| 6 | S-LEC BL5HP, a polyvinyl butyral from Sekisui |
| 7 | S-LEC BL16, a polyvinyl butyral from Sekisui |
| 8 | S-LEC B DSG12, a polyvinyl butyral from Sekisui |
| 9 | S-LEC KW23, a vinyl butyral-vinyl acetate-vinyl alcohol terpolymer from Sekisui |
| 10 | S-LEC KW3, a vinyl butyral-vinyl acetate-vinyl alcohol terpolymer from Sekisui |
| 11 | ALMACRYL ™ EB56, an isophthalic acid/adipic acid/ethylene glycol polymer (75–80:25–20:100 on molar basis) from Image Polymers |
| 12 | DEGALAN ™ M345, a poly(methyl methacrylate) from Degussa |
| 13 | JAGOTEX EM2245, a polyacrylate from E. Jager Fabrik GmbH |
| 14 | SARAN ™ F2202, a vinylidene chloride-acrylonitrile-copolymer [80/20 by weight] from Dow Chemical Co. |
| 15 | HIMER ™ ST95, a polystyrene from Sanyo Chemical Industries |
| 16 | Polystyrene 158K, a polystyrene from BASF |
| 17 | ERCOL ™ 48 20, a polyvinylalcohol from ACETEX EUROPE |
| 18 | CELVOL ™ 203, a polyvinyl alcohol from Celanese Chemicals |
| 19 | POVAL ™ R2105, a 98% hydrolyzed silanol-modified vinyl alcohol-vinyl acetate-copolymer from Kuraray |
| 20 | POVAL ™ R2130, a silanol-modified vinyl alcohol-vinyl acetate-copolymer from Kuraray |
| 21 | POVAL ™ 405, a vinyl alcohol-vinyl acetate-copolymer from Kuraray |

Ingredients in the protective layer:
ERCOL ™ 48 20 = a polyvinylalcohol from ACETEX EUROPE;
LEVASIL ™ VP AC 4055 = a 15% aqueous dispersion of colloidal silica with acid groups predominantly neutralized with sodium ions and a specific surface are of 500 m$^2$/g, from
BAYER AG has been converted into the ammonium salt;
ULTRAVON ™ W = 75–85% concentrate of a sodium arylsulfonate from Ciba Geigy converted into acid form by passing through an ion exchange column;
SYLOID ™ 72 = a silica from Grace;
SERVOXYL ™ VPDZ 3/100 = a mono[isotridecyl polyglycolether (3 EO)] phosphate, from SERVO DELDEN B.V.;
SERVOXYL ™ VPAZ 100 = a mixture of monolauryl and dilauryl phosphate, from SERVO DELDEN B.V.;
MICROACE TALC P3 = an Indian talc from NIPPON TALC;
RILANIT ™ GMS = a glycerine monotallow acid ester, from HENKEL AG
TMOS = tetramethylorthosilicate hydrolyzed in the presence of methanesulfonic acid.

COMPARATIVE EXAMPLES 1 TO 24 AND INVENTION EXAMPLES 1 TO 31

The substantially light-insensitive thermographic materials of COMPARATIVE EXAMPLES 1 to 24 and INVENTION EXAMPLES 1 to 31 were prepared by coating a dispersion with the following ingredients of thermosensitive element type 1 in 2-butanone onto a 175 μm thick blue-pigmented polyethylene terephthalate support with CIELAB a*- and b*-values of −9.5 and −17.9 respectively subbed on the emulsion-coated side with subbing layer 01 giving type 1 thermosensitive elements after drying at 50° C. for 1*h* in a drying cupboard, for composition see above. The type 1 thermosensitive elements were then coated with a barrier layer from a 2-butanone solution, for type of copolymer used and coating weight see Tables 1A and 1B. The barrier layers were then further coated with an aqueous composition with the following ingredients, which was adjusted to a pH of 3.8 with 1N nitric acid, to a wet layer thickness of 85 μm and then dried at 50° C. for 15 minutes to produce a protective layer PRO-L with the composition:

| | |
|---|---|
| ERCOL ™ 48 20 = | 2.1 g/m$^2$ |
| LEVASIL ™ VP AC 4055 = | 1.05 g/m$^2$ |
| ULTRAVON ™ W = | 0.075 g/m$^2$ |
| SYLOID ™ 72 = | 0.09 g/m$^2$ |
| SERVOXYL ™ VPDZ 3/100 = | 0.075 g/m$^2$ |
| SERVOXYL ™ VPAZ 100 = | 0.075 g/m$^2$ |
| MICROACE TALC P3 = | 0.045 g/m$^2$ |
| RILANIT ™ GMS = | 0.15 g/m$^2$ |
| TMOS = | 0.87 g/m$^2$ (assuming that the TMOS was completely converted to $SiO_2$) |

After coating the protective layer was hardened by heating the substantially light-insensitive thermographic material at 45° C. for 7 days at a relative humidity of 70%.

Thermographic Printing

The substantially light-insensitive thermographic recording materials of COMPARATIVE EXAMPLES 1 to 24 and INVENTION EXAMPLES 1 to 31 were printed using a DRYSTAR™ 4500 printer from AGFA-GEVAERT with a resolution of 508 dpi which had been modified to operate at a printing speed of 14 mm/s and a line-time of 3.5 ms instead of 7.1 ms and in which the 75 μm long (in the transport direction) and 50 μm wide thermal head resistors were power-modulated to produce different image densities. The maximum densities of the images ($D_{max}$) measured through a visible filter with a MACBETH™ TR924 densitometer were all greater than 2.0.

Assessment of Diffusion of Ingredients and Reaction Products of the Imaging Forming Process to Protective Layer Surface The diffusion of ingredients and reaction products of the imaging forming process to the surface of the protective layer was assessed visually according to a scale of 0 to 5 with the following criteria:

| | |
|---|---|
| diffusion assessment of 0: | no diffusion |
| diffusion assessment of 1: | first indication of diffusion upon examination under an intense lighting after rubbing with a paper tissue |
| diffusion assessment of 2: | visible in daylight after rubbing with a paper tissue |
| diffusion assessment of 3: | just visible in daylight without rubbing with a paper tissue |
| diffusion assessment of 4: | moderately strong deposition without rubbing with a paper tissue |
| diffusion assessment of 5: | very strong deposition without rubbing with a paper tissue |

The results for unprinted and printed materials after different times under ambient conditions (25° C.) are given in Tables 1A and 1B below for COMPARATIVE EXAMPLES 1 to 24 and INVENTION EXAMPLES 1 to 31 respectively.

TABLE 1A

| Comparative | Polymer | | Assessment of diffusion | | | | | | | |
|---|---|---|---|---|---|---|---|---|---|---|
| | | | prior to printing | | | | after printing | | | |
| Example Nr. | nr | coverage [g/m$^2$] | 0 d | 10 d | 20 d | 30 d | 0 d | 10 d | 20 d | 30 d |
| 1* | — | — | 5 | 5 | 5 | 5 | 3 | 5 | 5 | 5 |
| 2 | — | — | 0 | 0 | 0 | 0 | 0 | 1 | 1 | 2 |
| 3 | 1 | 1 | 0 | 0 | 0 | 0 | 0 | 0 | 2 | 3 |
| 4 | 2 | 2 | 0 | 0 | 0 | 0 | 1 | 2 | 2 | 2 |
| 5 | 3 | 2 | 0 | 0 | 0 | 0 | 1 | 3 | 3 | 3 |
| 6 | 4 | 2 | 0 | 0 | 0 | 0 | 1 | 2 | 2 | 2 |
| 7 | 5 | 2 | 0 | 0 | 0 | 0 | 0 | 1 | 2 | 2 |
| 8 | 6 | 2 | 0 | 0 | 0 | 0 | 0 | 2 | 2 | 2 |
| 9 | 7 | 2 | 0 | 0 | 0 | 0 | 0 | 2 | 2 | 2 |
| 10 | 8 | 2 | 0 | 0 | 0 | 0 | 0 | 2 | 3 | 3 |
| 11 | 9 | 2 | 0 | 0 | 1 | 1 | 0 | 3 | 3 | 3 |
| 12 | 10 | 2 | 0 | 0 | 0 | 0 | 0 | 3 | 3 | 3 |
| 13 | 11 | 2 | 0 | 0 | 0 | 0 | 2 | 2 | 2 | 2 |
| 14 | 12 | 2 | 0 | 0 | 0 | 0 | 0 | 2 | 2 | 2 |
| 15 | 13 | 2 | 0 | 0 | 0 | 0 | 0 | 1 | 2 | 2 |
| 16 | 14 | 2 | 0 | 0 | 0 | 0 | 0 | 1 | 2 | 2 |
| 17 | 15 | 2 | 0 | 0 | 0 | 0 | 1 | 2 | 2 | 2 |
| 18 | 16 | 2 | 0 | 0 | 0 | 0 | 0 | 2 | 2 | 2 |
| 19 | 18 | 2 | 0 | 0 | 0 | 1 | 0 | 3 | 4 | 3 |
| 20 | 18 | 1 | 0 | 0 | 0 | 1 | 0 | 3 | 3 | 4 |
| 21 | 19 | 2 | 0 | 0 | 0 | 0 | 0 | 0 | 2 | 2 |
| 22 | 19 | 1 | 0 | 0 | 0 | 0 | 0 | 1 | 2 | 3 |
| 23 | 20 | 2 | 0 | 0 | 0 | 0 | 2 | 2 | 2 | 2 |
| 24 | 21 | 1 | 0 | 0 | 0 | 0 | 0 | 3 | 4 | 4 |

*without a protective layer

TABLE 1B

| Invention | Copolymer | | Assessment of diffusion | | | | | | | |
|---|---|---|---|---|---|---|---|---|---|---|
| | | | prior to printing | | | | after printing | | | |
| Example nr. | nr | coverage [g/m$^2$] | 0 d | 10 d | 20 d | 30 d | 0 d | 10 d | 20 d | 30 d |
| 1 | 1 | 2.0 | 0 | 0 | 0 | 0 | 0 | 1 | 1 | 1 |
| 2 | 1 | 1.0 | 0 | 0 | 0 | 0 | 0 | 1 | 1 | 1 |
| 3 | 1 | 0.5 | 0 | 0 | 0 | 0 | 0 | 0 | 0 | 0 |
| 4 | 1 | 0.25 | 0 | 0 | 0 | 0 | 0 | 0 | 0 | 0 |
| 5 | 2 | 2.0 | 0 | 0 | 0 | 0 | 0 | 1 | 1 | 1 |
| 6 | 2 | 1.0 | 0 | 0 | 0 | 0 | 0 | 1 | 1 | 1 |
| 7 | 2 | 0.5 | 0 | 0 | 0 | 0 | 0 | 0 | 0 | 0 |
| 8 | 2 | 0.25 | 0 | 0 | 0 | 0 | 0 | 0 | 0 | 0 |
| 9 | 3 | 2.0 | 0 | 0 | 0 | 0 | 0 | 0 | 1 | 1 |
| 10 | 3 | 1.0 | 0 | 0 | 0 | 0 | 0 | 1 | 1 | 1 |
| 11 | 3 | 0.5 | 0 | 0 | 0 | 0 | 0 | 0 | 0 | 0 |
| 12 | 3 | 0.25 | 0 | 0 | 0 | 0 | 0 | 0 | 0 | 0 |
| 13 | 6 | 2.0 | 0 | 0 | 0 | 0 | 0 | 1 | 1 | 1 |
| 14 | 6 | 1.0 | 0 | 0 | 0 | 0 | 0 | 1 | 1 | 1 |
| 15 | 6 | 0.5 | 0 | 0 | 0 | 0 | 0 | 0 | 0 | 0 |
| 16 | 6 | 0.25 | 0 | 0 | 0 | 0 | 0 | 0 | 0 | 0 |
| 17 | 7 | 2.0 | 0 | 0 | 0 | 0 | 0 | 1 | 1 | 1 |
| 18 | 7 | 1.0 | 0 | 0 | 0 | 0 | 0 | 1 | 1 | 1 |
| 19 | 7 | 0.5 | 0 | 0 | 0 | 0 | 0 | 0 | 0 | 0 |
| 20 | 7 | 0.25 | 0 | 0 | 0 | 0 | 0 | 0 | 0 | 0 |
| 21 | 8 | 2.0 | 0 | 0 | 0 | 0 | 0 | 1 | 1 | 1 |
| 22 | 8 | 1.0 | 0 | 0 | 0 | 0 | 0 | 1 | 1 | 1 |
| 23 | 8 | 0.5 | 0 | 0 | 0 | 0 | 0 | 0 | 0 | 0 |
| 24 | 8 | 0.25 | 0 | 0 | 0 | 0 | 0 | 0 | 0 | 0 |
| 25# | 11 | 2 | 0 | 0 | 0 | 0 | 0 | 0 | 0 | 0 |
| 26# | 11 | 1 | 0 | 0 | 0 | 0 | 0 | 0 | 0 | 0 |
| 27# | 12 | 2 | 0 | 0 | 0 | 0 | 0 | 0 | 0 | 0 |
| 28# | 12 | 1 | 0 | 0 | 0 | 0 | 0 | 0 | 0 | 0 |
| 29# | 13 | 2 | 0 | 0 | 0 | 0 | 0 | 0 | 0 | 0 |
| 30# | 14 | 2 | 0 | 0 | 0 | 0 | 0 | 0 | 0 | 0 |
| 31# | 14 | 1 | 0 | 0 | 0 | 0 | 0 | 0 | 0 | 0 |

*without a protective layer, printing was carried out with a thin foil between the thermosensitive element and the thermal head of the printer
#coated from an aqueous solution The results of COMPARATIVE EXAMPLE 1 show that there is very considerable diffusion of ingredients and reaction products of the imaging forming process to the surface even prior to printing. The results for COMPARATIVE EXAMPLE 2 show that the protective layer used on the reaction product of polyvinyl alcohol with hydrolyzed tetramethoxysilane was able to prevent further transport to the surface of the protective layer prior to printing, but after printing considerable diffusion of ingredients and reaction products of the imaging forming process could be detected after 20 days.

The results of COMPARATIVE EXAMPLES 3 to 24 show that the ability of barrier layers of Polymer nr. 1 to 21, all outside the scope of the present invention, to prevent diffusion to the surface of the protective layer was inferior to the situation without a barrier layer. It is notable that Polymer nr. 1 to 4 together with a protective layer based on the reaction product of polysilicic acid and a hydroxy-containing polymer was reported in U.S. Pat. No. 5,264,334 to provide an effective barrier to ingredient diffusion.

given in Tables 2A and 2B for COMPARATIVE EXAMPLES 25 to 29 and INVENTION EXAMPLES 32 to 38 respectively.

The diffusion of ingredients and reaction products of the imaging forming process to the protective layer surface for COMPARATIVE EXAMPLES 25 to 29 and INVENTION EXAMPLES 32 to 38 was assessed as described for COMPARATIVE EXAMPLES 1 to 24 and INVENTION EXAMPLES 1 to 31 prior to printing and after printing as described for COMPARATIVE EXAMPLES 1 to 24 and INVENTION EXAMPLES 1 to 31. The results of the diffusion experiments are also given in Table 2.

The results of the diffusion experiments in Table 2 confirm the findings of INVENTION EXAMPLES 1 to 31, that copolymers 1 to 3 and 6 to 8 are able to prevent diffusion of ingredients and reaction products of the imaging forming process to the surface of the thermographic material both before and after printing for a period of 30 days under ambient conditions (25° C.).

TABLE 2

| | | | Assessment of diffusion | | | | | | | |
|---|---|---|---|---|---|---|---|---|---|---|
| Comparative | Polymer | | prior to printing | | | | after printing | | | |
| Example nr. | nr | coverage [g/m$^2$] | 0 d | 10 d | 20 d | 30 d | 0 d | 10 d | 20 d | 30 d |
| 25 | — | — | 0 | 0 | 0 | 0 | 0 | 1 | 2 | 2 |
| 26 | — | — | 0 | 0 | 0 | 1 | 0 | 1 | 2 | 2 |
| 27 | 6 | 2 | 0 | 0 | 0 | 0 | 0 | 2 | 3 | 3 |
| 28 | 17 | 1 | 0 | 0 | 0 | 0 | 1 | 1 | 2 | 2 |
| 29 | 17 | 2 | 0 | 0 | 1 | 1 | 1 | 2 | 1 | 2 |
| Invention | Copolymer | | | | | | | | | |
| Example nr. | nr | coverage [g/m$^2$] | | | | | | | | |
| 32 | 1 | 2 | 0 | 0 | 0 | 0 | 0 | 0 | 0 | 0 |
| 33 | 1 | 2 | 0 | 0 | 0 | 0 | 0 | 0 | 0 | 0 |
| 34 | 2 | 2 | 0 | 0 | 0 | 0 | 0 | 0 | 0 | 0 |
| 35 | 3 | 2 | 0 | 0 | 0 | 0 | 0 | 0 | 0 | 0 |
| 36 | 6 | 2 | 0 | 0 | 0 | 0 | 0 | 0 | 0 | 0 |
| 37 | 7 | 2 | 0 | 0 | 0 | 0 | 0 | 0 | 0 | 0 |
| 38 | 8 | 2 | 0 | 0 | 0 | 0 | 0 | 0 | 0 | 0 |

The results for INVENTION EXAMPLES 1 to 31, on the other hand, show that Copolymers nr. 1 to 3, 6 to 8 and 11 to 14, according to the present invention, are surprisingly able, at coverages from below 0.25 g/m$^2$ to above 2 g/m$^2$, to prevent diffusion of ingredients and reaction products of the imaging forming process to the surface of the protective layer over periods of 30 days under ambient conditions (25° C.) both before and after printing.

These copolymers can be grouped into copolymers comprising vinyl chloride and vinyl acetate units (Copolymers nr. 1 to 3), copolymers comprising styrene-acrylonitrile (Copolymers nr. 6 to 8), copolymers with cationic units (Copolymers nr. 11 to 13) and styrene-maleic acid copolymers (Copolymer nr. 14).

COMPARATIVE EXAMPLES 25 TO 29 AND INVENTION EXAMPLES 32 TO 38

The substantially light-insensitive thermographic materials of COMPARATIVE EXAMPLES 25 to 29 and INVENTION EXAMPLES 32 to 38 were prepared as described for COMPARATIVE EXAMPLES 1 to 24 and INVENTION EXAMPLES 1 to 31 except for the barrier layers, which are

Evaluation of Thermographic Properties

For a barrier layer to be usable in substantially light-insensitive thermographic materials, it is important that it is not only are to restrain the diffusion of ingredients and reaction products of the imaging forming process to the surface of the protective layer but also has no adverse effect on the image tone of the prints.

The image tone of fresh prints made with the substantially light-sensitive thermographic recording materials of COMPARATIVE EXAMPLES 25 to 29 and INVENTION EXAMPLES 32 and 38 was assessed on the basis of the L*, a* and b* CIELAB-values at optical densities, D, of 1.0 and 1.5 and the results are given in Table 3.

The results in Table 3 show that barrier layers of copolymer nr. 1 to 3 and 6 to 8 shifted the CIELAB b*-values of fresh prints with barrier layers slightly negatively with respect to the corresponding thermographic material of COMPARATIVE EXAMPLES 25 and 26, which renders the image tone more acceptable to a radiologist.

TABLE 3

| Comparative Example nr. | Copolymer nr | Copolymer coverage [g/m²] | CIELAB values of fresh print at D = 1.0 a* | D = 1.0 b* | D = 1.5 a* | D = 1.5 b* |
|---|---|---|---|---|---|---|
| 25 | — | — | −4.12 | −4.45 | −2.62 | −4.92 |
| 26 | — | — | −4.44 | −4.44 | −2.71 | −4.53 |
| 27 | 6 | 2 | −4.41 | −3.69 | −2.58 | −3.97 |
| 28 | 17 | 1 | −4.19 | −4.85 | −2.56 | −3.94 |
| 29 | 17 | 2 | −4.33 | −3.57 | −2.39 | −2.75 |
| **Invention Example nr.** | **Copolymer nr** | **Copolymer coverage [g/m²]** | | | | |
| 32 | 1 | 2 | −4.72 | −6.29 | −3.12 | −5.65 |
| 33 | 1 | 2 | −4.56 | −5.74 | −2.95 | −5.86 |
| 34 | 2 | 2 | −4.61 | −6.76 | −3.01 | −6.24 |
| 35 | 3 | 2 | −4.65 | −6.24 | −3.15 | −5.99 |
| 36 | 6 | 2 | −4.68 | −6.97 | −3.06 | −6.36 |
| 37 | 7 | 2 | −4.73 | −6.94 | −3.08 | −6.19 |
| 38 | 8 | 2 | −4.74 | −6.90 | −3.01 | −6.21 |

COMPARATIVE EXAMPLE 30 AND INVENTION EXAMPLES 39 TO 50

The substantially light-insensitive thermographic materials of COMPARATIVE EXAMPLE 30 and INVENTION EXAMPLES 39 to 50 were prepared by coating a dispersion with the ingredients of thermosensitive element type 2 in 2-butanone onto a 175 μm thick blue-pigmented polyethylene terephthalate support with CIELAB a*- and b*-values of −9.5 and −17.9 respectively subbed on the emulsion-coated side with subbing layer 01 giving type 2 thermosensitive elements after drying at 85° C. for 3 minutes in a drying cupboard, for composition of the type 2 thermosensitive element see above. The type 2 thermosensitive elements were then coated with a barrier layer from a 2-butanone solution, for copolymer type used and coating weight see Table 4. The barrier layers were then provided with the same protective layer as for the substantially light-insensitive thermographic materials of COMPARATIVE EXAMPLES 1 to 24 and INVENTION EXAMPLES 1 to 31.

The diffusion of ingredients and reaction products of the imaging forming process to the protective layer surface for COMPARATIVE EXAMPLE 30 and INVENTION EXAMPLES 39 to 50 was assessed as described for COMPARATIVE EXAMPLES 1 to 24 and INVENTION EXAMPLES 1 to 31 after subjecting prints to 3, 6, 9, 12, 15 and 18 days at 57° C. and 34% relative humidity, which provided a more rigorous test of the ability of these barrier layers to restrain diffusion of ingredients and reaction products of the imaging forming process to the surface. The results of these diffusion experiments are also given in Table 4.

TABLE 4

| Comparative Example nr. | Polymer nr | Polymer coverage [g/m²] | Assessment of diffusion for prints subjected to 57° C./34% RH for 3 d | 6 d | 9 d | 12 d | 15 d | 18 d |
|---|---|---|---|---|---|---|---|---|
| 30 | — | — | 2 | 2 | 4 | 5 | 5 | 5 |
| **Invention Example nr.** | **Copolymer nr** | **wet layer thickness [μm]** / **coverage [g/m²]** | | | | | | |
| 39 | 2 | 45 / 1 | 0 | 1 | — | — | — | — |
| 40 | 2 | 20 / 1 | 0 | 0 | — | — | — | — |
| 41 | 2 | 20 / 0.5 | 0 | 0 | — | — | — | — |
| 42 | 2 | 20 / 1 | 0 | 0 | 0 | 0 | 0 | 0 |
| 43 | 2 | 20 / 0.6 | 0 | 0 | 0 | 0 | 0 | 0 |
| 44 | 2 | 20 / 0.5 | 0 | 0 | 0 | 0 | 0 | 0 |
| 45 | 2 | 20 / 0.4 | 0 | 0 | 0 | 0 | 0 | 1 |
| 46 | 2 | 20 / 0.3 | 0 | 0 | 0 | 0 | 0 | 2 |
| 47 | 7 | 50 / 1 | 0 | 0 | — | — | — | — |
| 48 | 7 | 45 / 1 | 0 | 1 | — | — | — | — |
| 49 | 7 | 20 / 1 | 0 | 0 | — | — | — | — |
| 50 | 7 | 20 / 0.5 | 0 | 0 | — | — | — | — |

The results in Table 4 show that barrier layers of Copolymer nr. 2, a vinyl chloride-vinyl acetate-maleic acid anhydride copolymer, provides excellent restraint of the diffusion of ingredients and reaction products of the imaging forming process to the surface even under these more rigorous conditions and that barrier layers of Coploymer nr. 7, a styrene-acrylonitrile copolymer, also provided satisfactory restraint of the diffusion of ingredients and reaction products of the imaging forming process to the surface under these conditions.

Evaluation of Thermographic Properties

For a barrier layer to be usable in substantially light-insensitive thermographic materials, it is important that it is not only able to restrain the diffusion of ingredients and reaction products of the imaging forming process to the surface of the protective layer but also has no adverse effect on the image tone of the prints.

The image tone of fresh prints made with the substantially light-sensitive thermographic recording materials of COMPARATIVE EXAMPLE 30 and INVENTION EXAMPLES 39 to 50 was assessed on the basis of the L*, a* and b* CIELAB-values at optical densities, D, of 1.0 and 1.5 and the results given in Table 5.

TABLE 5

| Comparative Example nr. | Polymer nr | wet layer thickness [μm] | coverage [g/m²] | CIELAB values of fresh print D = 1.0 a* | D = 1.0 b* | D = 1.5 a* | D = 1.5 b* |
|---|---|---|---|---|---|---|---|
| 30 | — | | — | −4.95 | −7.07 | −3.26 | −5.74 |
| **Invention Example nr.** | **Copolymer nr** | **wet layer thickness [μm]** | **coverage [g/m²]** | | | | |
| 39 | 2 | 45 | 1 | −5.31 | −8.99 | −4.04 | −8.75 |
| 40 | 2 | 20 | 1 | −5.49 | −8.98 | −4.19 | −8.54 |
| 41 | 2 | 20 | 0.5 | −5.35 | −9.40 | −3.78 | −9.06 |
| 42 | 2 | 20 | 1 | −5.53 | −9.15 | −4.10 | −8.03 |
| 43 | 2 | 20 | 0.6 | −5.43 | −8.99 | −4.03 | −8.14 |
| 44 | 2 | 20 | 0.5 | −5.42 | −8.93 | −4.07 | −8.09 |
| 45 | 2 | 20 | 0.4 | −5.36 | −8.72 | −3.93 | −7.88 |
| 46 | 2 | 20 | 0.3 | −5.03 | −7.78 | −3.22 | −6.83 |
| 47 | 7 | 50 | 1 | −5.16 | −8.90 | −3.45 | −8.61 |
| 48 | 7 | 45 | 1 | −5.19 | −8.71 | −3.40 | −8.36 |
| 49 | 7 | 20 | 1 | −5.43 | −8.85 | −3.85 | −8.43 |
| 50 | 7 | 20 | 0.5 | −5.18 | −8.83 | −3.72 | −8.60 |

The results in Table 5 show that barrier layers of copolymer nr. 2 and 7 shifted the CIELAB b*-values of fresh prints with barrier layers slightly negatively with respect to the corresponding thermographic material of COMPARATIVE EXAMPLE 30, which rendered the image tone more acceptable to a radiologist. Furthermore, it was found that the attainable $D_{max}$ decreased for a given barrier layer coverage with decreasing wet layer thickness i.e. with increasing concentration of the Copolymer in the coating solution. A wet layer thickness above 30 μm had no further influence upon $D_{max}$ for copolymer-coverages of less than 0.4 g/m² and a wet layer thickness of 20 μm was possible for copolymer-coverages of less than 0.3 g/m².

COMPARATIVE EXAMPLE 31 AND INVENTION EXAMPLES 51 TO 62

The substantially light-insensitive thermographic materials of COMPARATIVE EXAMPLE 31 and INVENTION EXAMPLES 51 to 62 were prepared as described for COMPARATIVE EXAMPLE 30 and INVENTION EXAMPLES 39 to 50 except that type 2 thermosensitive elements were used and for the barrier layers, which are given in Table 6.

TABLE 6

| Comparative Example nr. | Polymer nr | coverage [g/m²] | assessment of diffusion for prints subjected to 57° C./ 34% RH for 3d |
|---|---|---|---|
| 31 | — | — | 5 |

TABLE 6-continued

| Invention Example nr. | Copolymer nr | coverage [g/m²] | |
|---|---|---|---|
| 51 | 2 | 1 | 0 |
| 52 | 3 | 1 | 0 |
| 53 | 4 | 1 | 0 |
| 54 | 5 | 1 | 0 |
| 55 | 5 | 1 | 0 |
| 56 | 6 | 1 | 0 |
| 57 | 7 | 1 | 0 |
| 58 | 9 | 1 | 0 |
| 59 | 10 | 1 | 0 |
| 60* | 11 | 1 | 0 |
| 61* | 12 | 1 | 0 |
| 62# | 14 | 1 | 0 |

*coated from an aqueous solution at pH 3.8
#coated from aqueous solution at pH 7

The diffusion of ingredients and reaction products of the imaging forming process to the protective layer surface for COMPARATIVE EXAMPLE 31 and INVENTION EXAMPLES 51 to 62 was assessed as described for COMPARATIVE EXAMPLES 1 to 24 and INVENTION EXAMPLES 1 to 31 after subjecting prints to 3 days at 57° C. and 34% relative humidity. The results are also given in Table 6.

No diffusion of ingredients and reaction products of the imaging forming process to the surface was observed in the case of barrier layers of Copolymers nr. 2 to 7, 9 to 12 and 14 with a coverage of 1 g/m². Most of these barrier layers were applied from 2-butanone solutions, but barrier layers of Copolymer nr. 11, 12 and 14 were applied from aqueous solutions. These copolymers can mainly be grouped into copolymers comprising vinyl chloride and vinyl acetate units (Copolymers nr. 1 to 5), copolymers comprising styrene-acrylonitrile (Copolymers nr. 6 to 10) and copolymers with cationic units (Copolymers nr. 11 and 12).

Evaluation of Thermographic Properties

The image tone of fresh prints made with the substantially light-sensitive thermographic recording materials of COMPARATIVE EXAMPLE 31 and INVENTION EXAMPLES 51 to 62 was assessed on the basis of the L*, a* and b* CIELAB-values at optical densities, D, of 1.0 and 1.5 and the results given in Table 7.

TABLE 7

| Comparative Example nr. | Polymer nr | coverage [g/m²] | CIELAB values of fresh print D = 1.0 a* | D = 1.0 b* | D = 1.5 a* | D = 1.5 b* |
|---|---|---|---|---|---|---|
| 31 | — | — | −2.67 | −9.42 | −0.45 | −9.22 |
| **Invention Example nr.** | **Copolymer nr** | **coverage [g/m²]** | | | | |
| 51 | 2 | 1 | −2.58 | −11.15 | −0.82 | −10.6 |
| 52 | 3 | 1 | −2.68 | −11.14 | −0.63 | −10.5 |
| 53 | 4 | 1 | −3.04 | −10.39 | −0.8 | −9.41 |
| 54 | 5 | 1 | −3.05 | −11.27 | −1.32 | −10.86 |
| 55 | 5 | 1 | −2.17 | −10.15 | +0.54 | −9.7 |

TABLE 7-continued

| | | | | | | |
|---|---|---|---|---|---|---|
| 56 | 6 | 1 | −2.34 | −10.63 | −0.03 | −10.1 |
| 57 | 7 | 1 | −2.4 | −10.41 | +0.16 | −9.81 |
| 58 | 9 | 1 | −2.54 | −10.58 | +0.12 | −10.04 |
| 59 | 10 | 1 | −2.53 | −10.2 | −0.15 | −9.68 |
| 60* | 11 | 1 | −2.32 | −8.3 | +0.33 | −7.15 |
| 61* | 12 | 1 | −2.14 | −8.85 | +0.77 | −8.35 |
| 62# | 14 | 1 | −2.73 | −8.87 | −0.14 | −8.76 |

*coated from an aqueous solution at pH 3.8
#coated from aqueous solution at pH 7

The results in Table 7 show that certain barrier layers of copolymer nr. 2 to 7, 9 to 12 and 14 shifted the CIELAB b*-values of fresh prints with barrier layers slightly negatively with respect to the corresponding thermographic material of COMPARATIVE EXAMPLE 31 (e.g. barrier layers of Copolymer nr. 2 to 7 and 9 and 10), which enhances the image tone, and others shifted the CIELAB b*-values slightly positively with respect to the corresponding thermographic material of COMPARATIVE EXAMPLE 31 (e.g. barrier layers of Copolymer nr. 11, 12 and 14, all coated from aqueous solutions). The composition of barrier layers of copolymers containing vinyl chloride and vinyl acetate units with various weight percentages of vinyl chloride and vinyl acetate units (Copolymer nr. 2 to 5) did not have a significant influence upon image tone i.e. for weight percentages of vinyl chloride units between 60 and 91 and for weight percentages of vinyl acetate between 3 and 15.

The composition of barrier layers of copolymers containing styrene and acrylonitrile with various weight percentages of styrene and acrylonitrile (Copolymer nr. 6, 7, 9 and 10) did not have a significant influence upon image tone i.e. for weight percentages of styrene units between 54 and 75 and for weight percentages of acrylonitrile between 25 and 46.

COMPARATIVE EXAMPLES 32 TO 39 AND INVENTION EXAMPLES 63 TO 74

The substantially light-insensitive thermographic materials of COMPARATIVE EXAMPLES 32 to 39 and INVENTION EXAMPLES 63 to 74 were prepared by coating dispersions containing the ingredients for the appropriate thermosensitive element type (see Table 8 for the thermosensitive element type used for the particular COMPARATIVE or INVENTION EXAMPLE) in 2-butanone onto the support described for COMPARATIVE EXAMPLES 1 to 24 and INVENTION EXAMPLES 1 to 31 giving the particular type of thermosensitive element for the particular COMPARATIVE or INVENTION EXAMPLE after drying at 85° C. for 3 minutes in a drying cupboard with the compositions given above. The thermosensitive elements were then optionally coated with a barrier copolymer from a 2-butanone solution, see Table 8 for copolymer type and coating weight. The barrier layers were then provided with the same protective layer as for the substantially light-insensitive thermographic materials of COMPARATIVE EXAMPLES 1 to 24 and INVENTION EXAMPLES 1 to 31.

The diffusion of ingredients and reaction products of the imaging forming process to the protective layer surface for COMPARATIVE EXAMPLES 32 to 39 and INVENTION EXAMPLES 63 to 74 was assessed as described for COMPARATIVE EXAMPLES 1 to 24 and INVENTION EXAMPLES 1 to 31 after subjecting fresh material and prints to different tests: 3 days and 6 days at 57° C. and 34% relative humidity; and 7 days at 45° C. and 70% relative humidity. The results are given in Table 8.

TABLE 8

| | | | | | Assessment of diffusion to material surface | | | | |
|---|---|---|---|---|---|---|---|---|---|
| | | | | | fresh material after 57° C./ | | prints after 57° C./ | | fresh material after 45° C./ |
| Comparative Example nr. | thermosensitive element type | Polymer nr | Polymer coverage [g/m²] | | 34% RH/ 3 d | 34% RH/ 6 d | 34% RH/ 3 d | 34% RH/ 6 d | 70% RH/ 7 d |
| 32 | 2* | — | — | | 0 | 0 | 5 | 5 | 5 |
| 33 | 2 | — | — | | 0 | 0 | 5 | 5 | 5 |
| 34 | 3* | — | — | | 0 | 0 | 5 | 5 | 5 |
| 35 | 3 | — | — | | 0 | 0 | 5 | 5 | 3 |
| 36 | 4* | — | — | | 0 | 0 | 5 | 5 | 5 |
| 37 | 4 | — | — | | 0 | 0 | 5 | 5 | 0 |
| 38 | 5* | — | — | | 0 | 0 | 5 | 5 | 5 |
| 39 | 5 | — | — | | 0 | 0 | 5 | 5 | 5 |
| Invention Example nr. | | Copolymer nr | wet layer thickness [μm] | cov-erage [g/m²] | | | | | |
| 63 | 2* | 6 | 10 | 0.79 | 0 | 0 | 0 | 0 | 0 |
| 64 | 2* | 6 | 20 | 0.79 | 0 | 0 | 0 | 0 | 0 |
| 65 | 2* | 6 | 30 | 0.79 | 0 | 0 | 0 | 0 | 0 |
| 66 | 2* | 6 | 40 | 0.79 | 0 | 0 | 0 | 0 | 0 |
| 67 | 2* | 6 | 50 | 0.79 | 0 | 0 | 0 | 0 | 0 |

TABLE 8-continued

| | | | | | | | | | |
|---|---|---|---|---|---|---|---|---|---|
| 68 | 2 | 6 | 50 | 0.79 | 0 | 0 | 0 | 0 | 0 |
| 69 | 3* | 6 | 50 | 0.79 | 0 | 0 | 0 | 0 | 0 |
| 70 | 3 | 6 | 50 | 0.79 | 0 | 0 | 0 | 0 | 0 |
| 71 | 4* | 6 | 50 | 0.79 | 0 | 0 | 0 | 0 | 0 |
| 72 | 4 | 6 | 50 | 0.79 | 0 | 0 | 0 | 0 | 0 |
| 73 | 5* | 6 | 50 | 0.79 | 0 | 0 | 0 | 0 | 0 |
| 74 | 5 | 6 | 50 | 0.79 | 0 | 0 | 1 | 1 | 0 |

*without a protective layer, printing was carried out with a thin foil between the thermosensitive element and the thermal head of the printer The experiments disclosed in Table 8 show whether the barrier layers of the present invention could be used with different thermosensitive elements with different compositions. On the basis of these experiments with a barrier layer of Copolymer nr. 6 with a coverage of 0.79 g/m$^2$, it can be seen that this barrier layer provides an excellent restraint of the diffusion of ingredients and reaction products of the imaging forming process to the surface of the thermographic material. Moreover, the results for INVENTION EXAMPLES 63 to 67, 69, 71 and 73 show that the barrier layer as such provides this restraint, which means that the choice of protective layer is not critical with respect to restraining ingredient diffusion and that the protective layer can be solely designed to optimise the mechanical interaction to the thermal printing head and the adhesion to the barrier layer.

The present invention may include any feature or combination of features disclosed herein either implicitly or explicitly or any generalisation thereof irrespective of whether it relates to the presently claimed invention. In view of the foregoing description it will be evident to a person skilled in the art that various modifications may be made within the scope of the invention.

Having described in detail preferred embodiments of the current invention, it will now be apparent to those skilled in the art that numerous modifications can be made therein without departing from the scope of the invention as defined in the following claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A substantially light-insensitive black and white monosheet thermographic recording material comprising a support and further comprising on one side of said support a thermosensitive element and at least two layers comprising a barrier layer and an outermost protective layer, said thermosensitive element being exclusive of a high contrast agent and comprising at least one substantially light-insensitive silver salt of a carboxylic acid, at least one reducing agent therefor in thermal working relationship therewith, at least one toning agent and at least one binder, wherein said at least one reducing agent is an ortho-dihydroxy-benzene derivative and said barrier layer comprises a copolymer comprising vinyl chloride units and vinyl acetate and/or vinyl alcohol units, a copolymer comprising styrene units and acrylonitrile units, a copolymer comprising cationic units and/or a copolymer comprising styrene units and maleic acid units.

2. A substantially light-insensitive black and white monosheet thermographic recording material comprising a support and further comprising on one side of said support a thermosensitive element, a barrier layer, and an outermost protective layer, said thermosensitive element being exclusive of a high contrast agent and comprising at least one substantially light-insensitive silver salt of a carboxylic acid, at least one reducing agent therefor in thermal working relationship therewith, at least one toning agent and at least one binder, wherein said at least one reducing agent is an ortho-dihydroxy-benzene derivative, said barrier layer comprises a copolymer comprising vinyl chloride units and vinyl acetate and/or vinyl alcohol units, a copolymer comprising styrene units and acrylonitrile units, a copolymer comprising cationic units and/or a copolymer comprising styrene units and maleic acid units, and said barrier layer is interposed between said thermosensitive element and said outermost protective layer.

3. The substantially light-insensitive black and white monosheet thermographic recording material according to claim 1, wherein said copolymer comprising vinyl chloride units and vinyl acetate units contains up to 95% by weight of vinyl chloride.

4. The substantially light-insensitive black and white monosheet thermographic recording material according to claim 1, wherein said copolymer comprising styrene units and acrylonitrile units contains between 20 and 60% by weight of acrylonitrile.

5. The substantially light-insensitive black and white monosheet thermographic recording material according to claim 1, wherein said copolymer containing cationic units contains quaternary ammonium, quaternary phosphonium or ternary sulphonium units.

6. The substantially light-insensitive black and white monosheet thermographic recording material according to claim 5, wherein said quaternary ammonium units are methacrylamidopropyl-trimethylammonium chloride or dimethyl-diallylammonium chloride units.

7. The substantially light-insensitive black and white monosheet thermographic recording material according to claim 1, wherein said toning agent is selected from the group consisting of naphthoxazine dione, naphthoxazine derivatives, 7-methyl-benzo[e][1,3]oxazine-2,4-dione, 7-methoxy-benzo[e][1,3]oxazine-2,4-dione and 7-(ethylcarbonato)-benzo[e][1,3]oxazine-2,4-dione.

8. The substantially light-insensitive black and white monosheet thermographic recording material according to claim 1, wherein said ortho-dihydroxy-benzene derivative is selected from the group consisting of catechol, 3-(3,4-dihydroxyphenyl) propionic acid, 3,4-dihydroxybenzoic acid, 3,4-dihydroxybenzoic acid esters, gallic acid, gallic acid esters, 3,4-dihydroxy-benzaldehyde, 3,4-dihydroxy-acetophenone, 3,4-butyrophenone, 3,4-dihydroxy-benzophenone, 3,4-dihydroxybenzophenone derivatives, 3,4-dihydroxy-benzonitrile, and tannic acid.

9. A substantially light-insensitive black and white monosheet thermographic recording material comprising a support and further comprising on one side of said support a thermosensitive element, a baffler layer, and an outermost protective layer, said thermosensitive element being exclusive of a high contrast agent and comprising at least one substantially light-insensitive silver salt of a carboxylic acid, at least one reducing agent therefor in thermal working relationship therewith, at least one toning agent and at least one binder, wherein said at least one reducing agent is an ortho-dihydroxy-benzene derivative; said barrier layer comprises a copolymer comprising vinyl chloride units and vinyl acetate and/or vinyl alcohol units, a copolymer comprising styrene units and acrylonitrile units, a copolymer comprising cationic units and/or a copolymer comprising styrene units and maleic acid units, and said outermost protective layer comprises the reaction product of at least one hydrolyzed polyalkoxysilane and a hydroxy-group containing polymer.

10. The substantially light-insensitive black and white monosheet thermographic recording material according to claim 1, wherein said outermost protective layer comprises the reaction product of a hydrolyzed tetra-alkoxysilane, e.g. tetramethoxysilane or tetra-ethoxysilane, and polyvinyl alcohol.

11. The substantially light-insensitive black and white monosheet thermographic recording material according to claim 2, wherein said copolymer containing cationic units contains quaternary ammonium, quaternary phosphonium or ternary sulphonium units.

12. The substantially light-insensitive black and white monosheet thermographic recording material according to claim 2, wherein said copolymer comprising vinyl chloride units and vinyl acetate units contains up to 95% by weight of vinyl chloride.

13. The substantially light-insensitive black and white monosheet thermographic recording material according to claim 2, wherein said copolymer comprising styrene units and acrylonitrile units contains between 20 and 60% by weight of acrylonitrile.

14. The substantially light-insensitive black and white monosheet thermographic recording material according to claim 11, wherein said quaternary ammonium units are methacrylamidopropyl-trimethylammonium chloride or dimethyl-diallylammonium chloride units.

15. The substantially light-insensitive black and white monosheet thermographic recording material according to claim 2, wherein said toning agent is selected from the group consisting of naphthoxazine dione, naphthoxazine derivatives, 7-methyl-benzo[e][1,3]oxazine-2,4-dione, 7-methoxy-benzo[e][1,3]oxazine-2,4-dione and 7-(ethylcarbonato)-benzo[e][1,3]oxazine-2,4-dione.

16. The substantially light-insensitive black and white monosheet thermographic recording material according to claim 2, wherein said ortho-dihydroxy-benzene derivative is selected from the group consisting of catechol, 3-(3,4-dihydroxyphenyl)propionic acid, 3,4-dihydroxybenzoic acid, 3,4-dihydroxybenzoic acid esters, gallic acid, gallic acid esters, 3,4-dihydroxy-benzaldehyde, 3,4-dihydroxy-acetophenone, 3,4-butyrophenone, 3,4-dihydroxy-benzophenone, 3,4-dihydroxybenzophenone derivatives, 3,4-dihydroxy-benzonitrile, and tannic acid.

17. The substantially light-insensitive black and white monosheet thermographic recording material according to claim 2, wherein said outermost protective layer comprises the reaction product of at least one hydrolyzed polyalkoxysilane and a hydroxy-group containing polymer.

18. The substantially light-insensitive black and white monosheet thermographic recording material according to claim 2, wherein said outermost protective layer comprises the reaction product of a hydrolyzed tetra-alkoxysilane, e.g. tetramethoxysilane or tetra-ethoxysilane, and polyvinyl alcohol.

19. The substantially light-insensitive black and white monosheet thermographic recording material according to claim 9, wherein said copolymer comprising vinyl chloride units and vinyl acetate units contains up to 95% by weight of vinyl chloride.

20. The substantially light-insensitive black and white monosheet thermographic recording material according to claim 9, wherein said copolymer comprising styrene units and acrylonitrile units contains between 20 aid 60% by weight of acrylonitrile.

21. The substantially light-insensitive black and white monosheet thermographic recording material according to claim 9, wherein said copolymer containing cationic units contains quaternary ammonium, quaternary phosphonium or ternary sulphonium units.

22. The substantially light-insensitive black and white monosheet thermographic recording material according to claim 21, wherein said quaternary ammonium units are methacrylamidopropyl-trimethylammonium chloride or dimethyl-diallylammonium chloride units.

23. The substantially light-insensitive black and white monosheet thermographic recording material according to claim 9, wherein said toning agent is selected from the group consisting of naphthoxazine dione, naphthoxazine derivatives, 7-methyl-benzo[e][1,3]oxazine-2,4-dione, 7-methoxy-benzo[e][1,3 ]oxazine-2,4-dione and 7-(ethylcarbonato)-benzo[e][1,3]oxazine-2,4-dione.

24. The substantially light-insensitive black and white monosheet thermographic recording material according to claim 9, wherein said ortho-dihydroxy-benzene derivative is selected from the group consisting of catechol, 3-(3,4-dihydroxyphenyl) propionic acid, 3,4-dihydroxybenzoic acid, 3,4-dihydroxybenzoic acid esters, gallic acid, gallic acid esters, 3,4-dihydroxy-benzaldehyde, 3,4-dihydroxy-acetophenone, 3,4-butyrophenone, 3,4-dihydroxy-benzophenone, 3,4-dihydroxybenzophenone derivatives, 3,4-dihydroxy-benzonitrile, and tannic acid.

25. The substantially light-insensitive black and white monosheet thermographic recording material according to claim 23, wherein said copolymer containing cationic units contains quaternary ammonium, quaternary phosphonium or ternary sulphonium units.

26. The substantially light-insensitive black and white monosheet thermographic recording material according to claim 25, wherein said quaternary ammonium units are methacrylamidopropyl-trimethylammonium chloride or dimethyl-diallylammonium chloride units.

* * * * *